United States Patent [19]

McGill et al.

[11] Patent Number: 4,538,982

[45] Date of Patent: Sep. 3, 1985

[54] FLARE GAS COMBUSTION APPARATUS

[75] Inventors: Eugene C. McGill, Skiatook; Robert L. Rawlings, Jenks, both of Okla.

[73] Assignee: McGill Incorporated, Tulsa, Okla.

[21] Appl. No.: 365,588

[22] Filed: Apr. 5, 1982

[51] Int. Cl.[3] ..... F23D 13/20

[52] U.S. Cl. ..... 431/202

[58] Field of Search ..... 431/4, 202, 114, 284; 239/421, 424.5, 418; 432/72

[56] References Cited

U.S. PATENT DOCUMENTS

| | | | |
|---|---|---|---|
| 2,779,399 | 1/1957 | Zink et al. | 431/202 X |
| 3,055,417 | 9/1962 | Reed | 431/202 X |
| 3,279,520 | 10/1966 | Wiesenthal | 431/202 X |
| 3,289,729 | 12/1966 | Reed | 431/202 |
| 3,512,911 | 9/1970 | Reed et al. . | |
| 3,547,567 | 7/1970 | Turpin . | |
| 3,554,681 | 9/1971 | Proctor . | |
| 3,824,073 | 7/1974 | Straitz | 431/202 X |
| 3,914,093 | 10/1975 | Proctor . | |
| 3,915,622 | 10/1975 | Desty et al. | 431/202 X |
| 3,994,671 | 11/1976 | Straitz, III | 431/202 |
| 3,995,986 | 12/1976 | Straitz | 431/202 X |

FOREIGN PATENT DOCUMENTS

| | | | |
|---|---|---|---|
| 923037 | 3/1973 | Canada | 431/354 |
| 2007830 | 5/1979 | United Kingdom | 431/202 |
| 2028489 | 3/1980 | United Kingdom | 431/202 |

OTHER PUBLICATIONS

Sales Brochure of Flaregas Engineering Ltd. entitled, "Anti-Pollutant Flare Systems".

*Primary Examiner*—Randall L. Green
*Attorney, Agent, or Firm*—Bill D. McCarthy

[57] ABSTRACT

A flare gas combustion apparatus comprising a flare housing and a liner cylinder member coaxially disposed therewithin, an annular orifice channel formed between the liner cylinder and the flare housing. A first flare conduit is in fluid communication with the orifice channel and a first flare gas portion passing through the flare conduit is discharged from the orifice channel at the upper end of the flare housing as a perimeter zone discharge configured as a relatively thin cylindrical layer of flare gas. A second flare conduit may be provided in fluid communication with the inner core of the liner cylinder to discharge a second flare gas portion therethrough as an inner zone discharge, and a liquid seal is provided to permit flare gas to pass via the second flare conduit only when the pressure of the inlet flare gas exceeds a predetermined value.

12 Claims, 7 Drawing Figures

FLARE GAS COMBUSTION APPARATUS

BACKGROUND OF INVENTION

1. Field of the Invention

The present invention relates to combustion devices which are designed for the disposal of flare gases by the process of combustion, and more particularly but not by way of limitation, to an improved flare gas combustion apparatus for the smokeless burning of hydrocarbon gases and vapors.

2. Discussion

There are many facilities, such as refineries, that must dispose of flare gases in a safe and effective manner as directed by both local and federal governmental regulations. Prior art devices to accomplish this usually include a flare stack having a flare tip disposed sufficiently high enough above the terrain to disperse the combusted gaseous products into the prevailing wind and limit the thermal radiation to safe levels. It is to be expected, especially in view of recent clean air laws and ordinances, that the combustion must be complete and smokeless to minimize environmental disturbance. It is also desirable to have such devices capable of handling quanitities of gases in excess of normal discharge loads during temporary plant upsets. Further, it is usually desirable to have a purge reduction device and/or a flash back prevention device which protects the plant from any inner conduit combustion.

Prior art devices typically use steam or air as a smoke suppressant, and the flare tip must deliver steam and air in adequate quantities to promote rapid mixing of these suppressants and gases in the combustion zone at the upper end of the stack. The steam serves to break up the discharging flare gas and promote more complete combustion. There are numerous such prior art devices which have been designed to effect smokeless, flare tip combustion of flare gases.

For example, U.S. Pat. No. 2,779,399, issued to Zink and Reed, teaches a flare tip structure to combust flare gas comprising hydrocarbons and other flammable raw materials. A flare stack tube has a main gas flare tip mounted at its upper end, and a sleeve surrounds the upper end of the tube forming an annular space about the flare stack. The purpose of the annular space is to communicate air and steam into the burning flare gas discharging from the flare stack tip. Steam is sprayed into the burning mass of gas via a centrally disposed tubular member and a manifold surrounding the burning tip; thus steam and air are drawn into the flame mass.

U.S. Pat. No. 3,512,911, also issued to Zink and Reed, teaches the use of air and steam which is directed into the center of the flare tip to break up the flame by developing turbulence to mix the steam and air with the flare gas to promote smokeless burning.

U.S. Pat. No. 3,547,567, issued to Turpin, teaches a flare stack combustion tip which breaks up the main gas flow into plural flow segments. The flare tip is affixed to the top of a flare stack or to the top of a centrally disposed flare gas conduit, the tip having a plurality of gas conducting channels which serve as gas emission orifices through which the flare gas is discharged for burning. Steam and air are directed through a shroud which surrounds the flare tip.

U.S. Pat. No. 3,554,631, issued to Procter, teaches a flare stack tip which attaches to the upper end of a flare stack. Rows of air-inducing devices are disposed to drive steam and air into the tip to mix with the flare gas flowing up through the stack, with the air-inducing devices operating under the Coanda principle. Proctor's later patent, U.S. Pat. No. 3,914,093, teaches a further development in a Coanda inducing device.

While most of the prior art flare gas combustion devices, including those taught by the above mentioned patents, provided devices which achieved varying degrees of success, they were generally expensive to fabricate and/or to operate, and experienced high maintenance costs. Devices which served to break up the "log mass" of the flare gases (so called because of the large tubular mass discharge from most prior art flare stacks) involved devices having components subjected directly or indirectly to the intense heat of the flame by placing the operating components in or near the flame mass, resulting in early burn out of the components. As to high operating expense using steam in quantities sufficient to suppress large masses of flare gases, this often diminished the value of otherwise well designed flare combustion devices.

SUMMARY OF THE INVENTION

The present invention provides an improved flare gas combustion apparatus which effects the smokeless combustion of hydrocarbon gases and vapors by configuring the flare gas into a perimeter zone discharge shaped to break up the central log effect created by a mass of flare gas discharging from a flare stack.

The flare gas combustion apparatus of the present invention comprises a flare housing and a gas directing means disposed within the flare housing forming an orifice channel with the flare housing. A first flare conduit in fluid communication with the orifice channel passes a first flare gas portion through the orifice channel to exhaust same at an exit port of the orifice channel at the upper end of the flare housing.

In one embodiment, a liner member is supported within the flare housing, forming an orifice channel between the inner wall of the flare housing and the outer wall of the liner member, with the first flare gas portion discharging from the orifice channel in the form of a perimeter zone discharge. Fluids, such as steam, air, natural gas, water or combination of such fluids, can be directed into the perimeter zone discharge.

In one embodiment, an overflow condition is accommodated via a second flare conduit which is capable of passing flare gas in excess of normal operating conditions by discharging a portion of the flare gas as an inner zone discharge.

An object of the present invention is to provide an improved flare gas combustion apparatus which provides smokeless flare combustion of hydrocarbon gases and the like.

Another object of the present invention, while achieving the above object, is to provide a flare gas combustion apparatus having smokeless flame combustion capability while providing ease of component fabrication.

Another object of the present invention, while achieving the above stated objects, is to provide an improved flare gas combustion apparatus which is substantially more economical to operate and to maintain.

Still another object of the present invention, while achieving the above stated objects, is to provide an improved flare gas combustion apparatus which requires less energy to achieve its function.

Another object of the present invention, while achieving the above stated objects, is to provide an improved flare gas combustion apparatus which provides better mixing of air with the discharging flare gas to facilitate complete combustion.

Another object of the present invention, while achieving the above stated objects, is to provide an improved flare gas combustion apparatus which minimizes the amount of purge gas required to retard atmospheric air from backflowing into the flare stack through the discharge end of the stack.

Another object of the present invention, while achieving the above stated objects, is to provide a flare gas combustion apparatus which retards flash back combustion to protect the plant from inner conduit combustion.

Other objects, features and advantages of the present invention will become clear from the disclosure provided hereinbelow when read in conjunction with the included drawings and appended claims.

DESCRIPTION OF THE INVENTION

The present invention relates to the smokeless burning of hydrocarbon gases and vapors as in an emergency relief flare system and the like. As mentioned above, prior art flare combustion devices utilize high pressure steam, usually 100 psig and greater, to mix with a hydrocarbon flame mass to effect smokeless burning. The steam is used at a rate of about 0.3 to 0.4 pounds of steam consumption per pound of flare gas burned. It is clear that maximum utilization of flame breakup must be achieved wile conserving the amount of steam used, or the amount of steam that would be required would become cost prohibitive. The present invention presents a unique solution to flare gas combustion because it configures the waste gas discharge into a relatively thin, perimeter zone discharge in the form of a cylindrical layer that can be caused to diverge as desired to more easily turbulate with steam and air.

Figure 1:
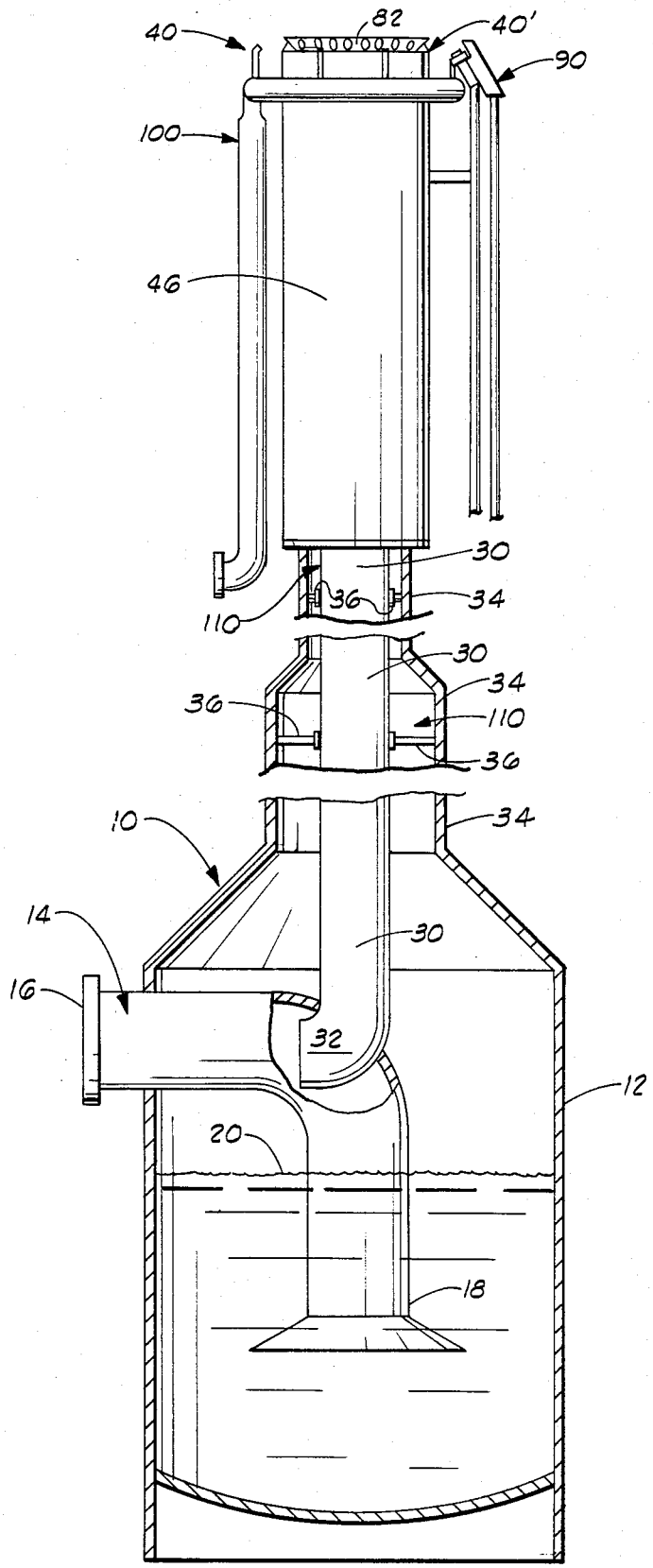
FIG. 1 shows a partial cutaway, cross-sectional view of a two stage flare gas combustion apparatus constructed in accordance with the present invention.

Referring to the drawings in general, and with specific reference to FIG. 1, shown therein is a flare gas combustion apparatus 10 which is shown in partial cutaway, cross-sectional view. Some of the length of the flare stack combustion apparatus 10 has been omitted in order to show the apparatus in greater detail in FIG. 1. As will become clear, the flare gas combustion apparatus 10 is a two stage apparatus which is designed to process flare gases during normal operations via a first flare conduit and to utilize a second flare conduit to handle quantities of flare gas in excess of normal operations.

The flare gas combustion apparatus 10 comprises a lower portion or seal tank 12 having a flare gas inlet conduit 14 having a first end 16 adapted to receive a flare gas from a facility such as a refinery. The flare gas inlet conduit 14 is generally L-shaped and has a second end 18 which is turned downwardly into the seal tank 12. A liquid, such as water, is maintained in the seal tank 12 so as to have a liquid level 20 which is disposed above the second end 18 of the flare gas inlet conduit 14.

Figure 2:
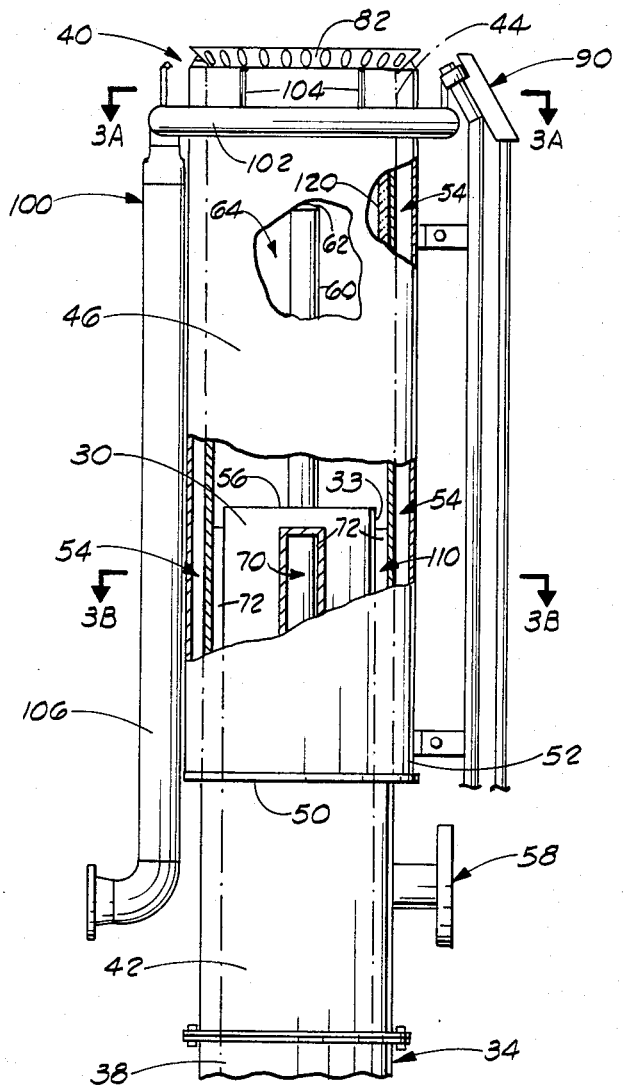
FIG. 2 shows a partial cutaway view of the flare tip assembly of FIG. 1.

A first flare conduit 30 has a lower end 32 which extends through the wall of the flare gas inlet conduit 14 and is sealed thereto to be disposed in flare gas receiving relationship to the flare gas inlet conduit 14 in the manner shown, and the first flare conduit 30 has an upper end 33 which is viewable in the partial cutaway view of FIG. 2. The first flare conduit 30 extends upwardly and is supported by an outer stack, or second flare conduit, 34 which is attached to and communicates with the seal tank 12. For structural strength, the second flare conduit 34 may neck down in diameter in stages in conventional fashion as shown, or external support may be provided, such as by guy wires or by a supporting derrick. The first flare conduit 30 and the second flare conduit 34 are substantially coaxially disposed to each other, and a number of support members 36 extend therebetween to unitize these two structures.

Attached to the upper end 38 of the second flare conduit 34 is a flare tip assembly 40 shown in partial cutaway cross-sectional view in FIG. 2. The flare tip assembly 40 comprises a bolt-on conduit section 42, also referred to as a liner cylinder member, which extends upwardly from the second flare conduit 34 and has an upper end 44. The flare tip assembly 40 also comprises a cylindrically or tubularly shaped flare housing 46 which is supported by a number of vertical divider members 48, viewed in FIG. 3A, which attach to the outer wall of the liner cylinder 42, and by an annular bottom plate 50 which is welded to the outer wall of the liner cylinder 42 at its lower end 52. Formed between the coaxially disposed liner cylinder 42 and the flare housing 46 is an annular orifice channel 54 which is open at the upper end 44 of the liner cylinder 42 and sealed at the lower end 52 by the bottom plate 50.

The upper end 33 of the first flare conduit 30 extends into the liner cylinder 42 and terminates below the upper end 44 thereof. The upper end 33 is capped with a plate 56. A fluid injector pipe 58 extends through the walls of the liner cylinder 42 and the first flare conduit 30 and has a vertically extensive leg 60 which extends through the plate 56. The tip end of the injector pipe 58 has a nozzle 62 which is disposed below the upper end 44 of the liner cylinder 42 and serves to inject a fluid, such as steam, air, natural gas, water or combinations of such fluids, into the inner core 64 of the liner cylinder 42 as may be required to break up the core flame. The fluid injector pipe is connected to a source of desired injection fluid as required.

Figure 3A:
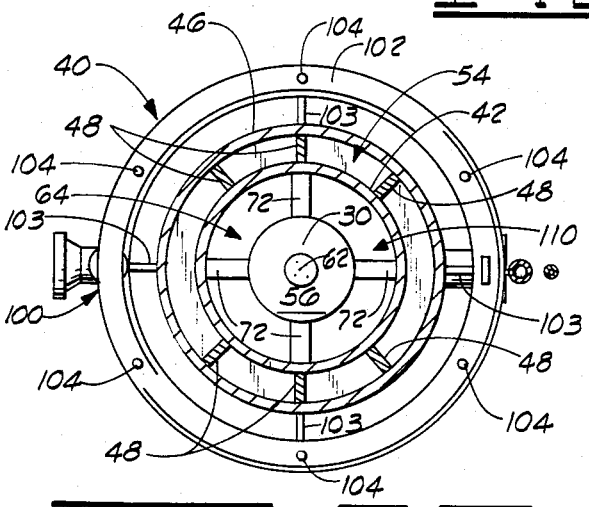
FIG. 3A shows a view of the annular orifice channel of the flare tip assembly taken at 3A—3A in FIG. 2.
Figure 3B:
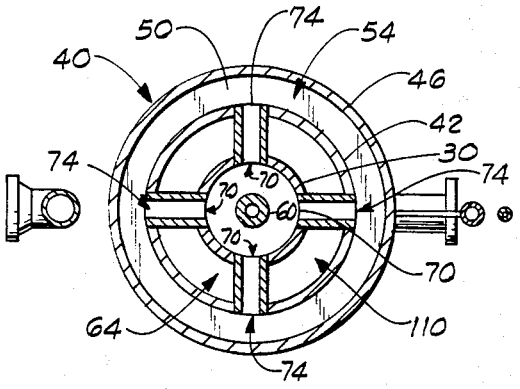
FIG. 3B shows a view taken at 3B—3B in FIG. 2

As shown in FIGS. 2, 3A and 3B, the first flare conduit 30 communicates with the annular orifice channel 54 via a plurality of flow openings 70 disposed about the upper end 33 thereof. A like number of conduits 72 connect to and extend radially from the first flare conduit 30 and connect to the liner cylinder 42 at similarly located flow openings 74 such that fluid communication is established between the first flare conduit 30 and the annular orifice channel 54. The divider members 48 extend only for a portion of the length of the liner cylinder 42 and serve to compartmentize the annular orifice channel 54. Flare gas passes from the first flare conduit 30 to the annular orifice channel 54 via the conduits 72 and passes upwardly through the annular orifice channel 54 to discharge as a relatively thin layer of discharge gas from the upper end of the flare tip assembly 40. That is, the flare gas discharging from the annular orifice channel 54 forms a perimeter zone discharge as indicated by the arrow 80 shown in FIG. 4.

Figure 4:
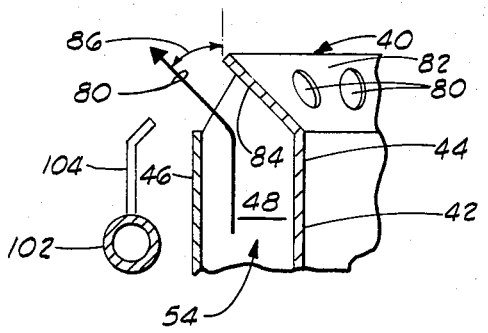
FIG. 4 shows a cross-sectional cutaway view of a portion of the exit port of the annular orifice channel of the flare tip assembly of FIG. 2.

FIG. 4 is an enlargement of the exit port of the annular orifice channel 54 which is formed at the top end of the flare tip assembly 40. Discharging gas is caused to diverge from a cylindrical flow discharge pattern by a deflector ring 82 supported by the liner cylinder 42 at the upper end 44 thereof. The deflector ring 82 has a flare gas diverting surface 84 positioned so that the perimeter zone discharge of the flare gas is caused to diverge at a predetermined divergent angle 86. The deflector ring 82 may be provided with a plurality of apertures 88 which communicate with the inner core 64 of the liner cylinder 42 and with the annular orifice channel 54 at the exit port. As is known, such apertures can be helpful in achieving desirable flame characteristics. However, it may be that the deflector plate 82 will not be used in certain applications, in which case the perimeter zone discharge will be an upwardly moving, relatively thin cylindrical layer of flare gas. Disposed near the upper end of the flare tip assembly 40 is a conventional igniter assembly 90 that is used to ignite the discharging flare gas as required.

The flare tip assembly 40 also comprises a fluid injector assembly 100 which is used for directing selected fluids into the perimeter zone discharge. The fluid injector assembly 100 comprises a hollow pipe ring 102 supported around the flare housing 46 below the upper end thereof via standoff members 103. The hollow pipe ring 102 has a plurality of discharge apertures, and located about the pipe ring 102 are a plurality of fluid nozzles 104 that communicate with the discharge apertures. Each fluid nozzle (only a few are shown in the drawings, but the number may be established as required) extends upwardly from the pipe ring 102 and is disposed to discharge fluid toward the perimeter zone discharge as shown in FIG. 4. An inlet fluid conduit 106 is connected to the pipe ring 102 and is connected to a source of pressurized fluid such as air, natural gas, water or combination of such fluids. Of course, this list of possible fluids is illustrative only, and an appropriate fluid may be selected as required to effect the desired flame characteristics.

The flare gas combustion apparatus 10 depicted in FIGS. 1 through 3B is a two stage unit. As discussed above, flare gas enters the flare gas inlet conduit 14 at its first end 16 and a first flare gas portion enters the first flare conduit 30 via its lower end 32. The liquid in the seal tank 12 seals the second end 18 of the flare gas inlet conduit 14 until the flare gas entering the flare gas inlet conduit 14 reaches sufficient pressure to overcome the liquid head of the seal fluid, such as when emergency conditions require a greater amount of flare gas discharge than can be accommodated through the first flare conduit 30. Once the pressure of the incoming flare gas becomes great enough to blow the seal liquid, a second flare gas portion passes into the second flare conduit 34.

As shown in FIGS. 1 and 2, the second flare conduit 34 is coaxially disposed to the first flare conduit 30 so that a second annular orifice channel 110 is formed between the external wall of the first flare conduit 30 and the internal wall of the second flare conduit 34. The second annular orifice channel 110 extends the length of the second flare conduit 34 and continues between the external wall of the first flare conduit 30 and the internal wall of the liner cylinder 42 for the remaining length of the first flare conduit 30 where it communicates with the inner core 64 of the liner cylinder 42. The liner cylinder 42 is open at its upper end 44 so that the second flare gas portion passing via the flare gas inlet conduit 14 and the second annular orifice channel 110 to the inner core 64 of the liner cylinder 42 will be discharged upwardly as an inner zone discharge configured as a mass log. A refractory lining 120 is adhered to a portion of the internal wall of the liner cylinder 42 at its upper end 44 to protect the structure from this burning mass log of flare gas as well as to protect against flame licking of the liner cylinder 42 by the burning first flare gas portion during normal operations. (The refractory lining 120 is omitted from FIG. 3A to better show the other components.) The duration of flow of the second flare gas portion will usually be for a brief period of time, so this temporary passage of the second flare gas portion is acceptable.

Once the emergency dumping conditions are over, and the pressure of the incoming flare gas will once again drop to normal, and the liquid seal can be re-established in the seal tank 12 by conventional means (not shown) that will sense the liquid level 20 and direct additional seal liquid into the seal tank 12 until the liquid level 20 rises to a predetermined height above the second end 18 of the flare gas inlet conduit 14.

Figure 5:
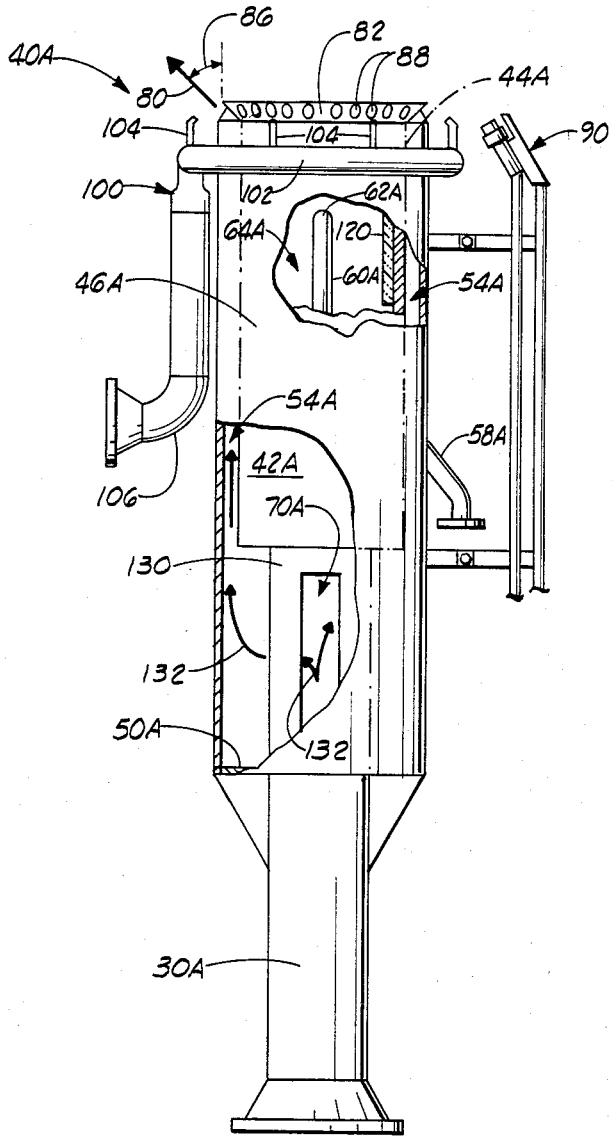
FIG. 5 is a partial cutaway of another flare tip assembly.

Shown in FIG. 5 is a single stage embodiment of a flare tip assembly 40A which attaches to the upper end of a conventional, single conduit flare stack (not shown). The flare tip assembly 40A functions in the same manner as does the flare tip assembly 40 with respect to the first flare gas portion which flows through the first flare conduit 30. That is, the flare gas discharge of the first flare gas portion will be configured as a relatively thin layer of cylindrically shaped flare gas which may be diverged by the deflector ring 82. Similar numbers will be used to depict component parts of the flare tip assembly 40A which are similar to those described hereinabove for the flare tip assembly 40.

The flare tip assembly 40A comprises a bolt-on flare conduit section 30A which extends upwardly from a conventional flare stack, the flare conduit 30A having an upper end 130. Attached to the upper end 130 is a liner cylinder 42A having a bottom end wall (not shown) which is weldingly attached to the flare conduit 30A to seal it at its upper end 130. The liner cylinder 42A extends upwardly from the upper end 130 of the flare conduit 30A and the deflector ring 82 is attached to the upper end 44A thereof.

The flare tip assembly 40A also comprises a cylindrically or tubularly shaped flare housing 46A which is connected to the liner cylinder 42A by a number of vertical divider members (not shown but similar to the vertical divider members 48 described hereinabove for the flare tip assembly 40). An annular bottom plate 50A is welded to the flare housing 46A and to the outer wall of the flare conduit 30A. Formed between the coaxially disposed liner cylinder 42A and the flare housing 46A is an annular orifice channel 54A which is open at the upper end 44A of the liner cylinder 42A and sealed at the lower end by the bottom plate 50A.

A fluid injector pipe 58A extends through the walls of the flare housing 46A and the liner cylinder 42A and has a vertically extensive leg 60A with a tip end nozzle 62A which is disposed below the upper end 44A of the liner cylinder 42A. The nozzle 62A is provided for the purpose of injecting a fluid into the inner core 64A of the liner cylinder 42A as may be required to break up the core flame.

At the upper end 130 of the flare conduit 30A are a plurality of flow openings 70A which provide fluid communication between the flare conduit 30A and the annular orifice channel 54A as indicated by the arrows 132.

As noted above, the flare tip assembly 40A is a single stage flare gas combustor, with provision for accommodating only a first flare gas portion; that is, there is no provision to accommodate a second flare gas portion as was the case for the earlier discussed flare tip assembly 40. In the flare tip assembly 40A, flare gas passes upwardly via the flare conduit 30A and passes via the plural flow openings 70A to the annular orifice channel 54A from which the flare gas discharges at the exit port provided at the top of the flare tip assembly 40A. The exit port of the flare tip assembly 40A is identical in construction detail to that described for the flare tip assembly 40 with reference to FIG. 4. The flare gas discharging from the annular orifice channel 54A forms a perimeter zone discharge as indicated by the arrow 80 in FIG. 5, and this perimeter zone discharge may be diverged from an upwardly rising cylindrical configuration by the deflector ring 82 if provided.

The flare tip assembly 40A may also be equipped with the fluid injector assembly 100, described hereinabove, and with the conventional igniter assembly 90. Also, the upper portion of the internal wall of the liner cylinder 42A may be lined with the refractory 120.

Figure 6:
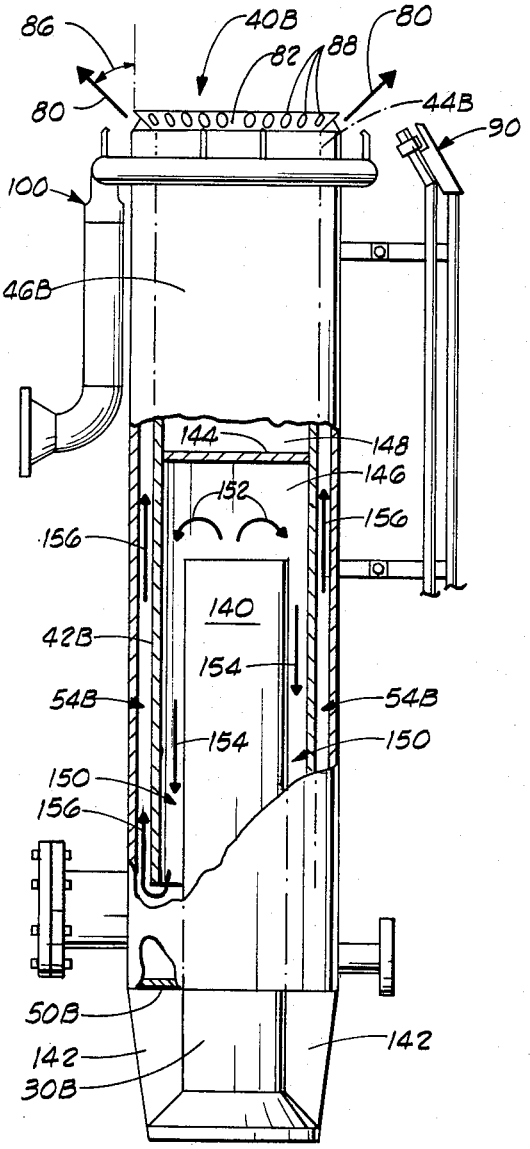
FIG. 6 is a partial cutaway view of yet another flare tip assembly.

Another embodiment of a single stage flare tip assembly is shown in FIG. 6. Shown therein is a flare tip assembly 40B which attaches to the upper end of a conventional, single conduit flare stack (not shown). The flare tip assembly 40B functions in the same manner as does the flare tip assembly 40 with respect to the flare gas portion which flows through the first flare conduit 30. That is, as discussed above for the flare tip assembly 40A, the flare gas discharge of the first flare gas portion will be configured as a relatively thin layer of cylindrically shaped flare gas which may be diverged by the deflector ring 82. For clarity, similar numbers will again be used to depict component parts of the flare tip assembly 40B which are similar to those described hereinabove for the flare tip assembly 40.

The flare tip assembly 40B comprises a bolt-on flare conduit section 30B which extends upwardly from a conventional flare stack, the flare conduit 30B having an open upper end 140. A cylindrically or tubularly shaped flare housing 46B is connected to the flare conduit 30B via a pair of gusset supports 142 and by an annular bottom plate 50B welded to the lower end of the flare housing 46B and to the outer wall of the flare conduit 30B. Disposed coaxially within the flare housing 46B is a liner cylinder 42B which is supported via a number of vertically extending divider members which are not shown but which are similar to the vertical divider members 48 described hereinabove for the flare tip assembly 40, the vertical divider members weldingly interconnecting the liner cylinder 42B and the flare housing 46B.

Formed between the coaxially disposed liner cylinder 42B and the flare housing 46B is an annular orifice channel 54B which is open at the upper end 44B of the liner cylinder 42B, the annular orifice channel 54B being sealed at its lower end by the bottom plate 50B.

The liner cylinder 42B has a seal plate 144 welded to the internal wall of the liner cylinder 42B and dividing same into a lower portion 146 and an upper portion 148. The flare conduit 30B extends upwardly into the lower portion 146B of the liner cylinder 42B, having its upper end 140 disposed below the seal plate 144. Formed between the inner wall of the liner cylinder 42B and the outer wall of the flare conduit 30B is an annularly shaped reverse flow channel 150, the reverse flow channel 150 having fluid communication with the annular orifice channel 54B as shown in FIG. 6.

The flare tip assembly 40B is a single stage flare gas combustor, with provision for accommodating only a first flare gas portion; that is, there is no provison to accommodate a second flare gas portion as was the case for the earlier discussed flare tip assembly 40. In the flare tip assembly 40B, flare gas passes upwardly via the flare conduit 30B and flows from the upper end 140, the upward flow thereof being blocked by the plate 144 which serves to seal the upper portion 148 of the liner cylinder 42B. The flare gas is caused to reverse its upward direction to flow downwardly through the annularly shaped reverse flow channel 150 as indicated by the arrows 152 and 154. The lower end of the liner cylinder 42B is disposed somewhat above the bottom plate 50B, and the gas discharging from the reverse flow channel 150 is again caused to reverse its direction and to flow upwardly into the annular orifice channel 54B, as indicated by the arrows 156; the flare gas discharges at the exit port of the annular flow channel 54B provided at the top of the flare tip assembly 40B. The exit port of the flare tip assembly 40B is identical in construction detail to that described for the flare tip assembly 40 with reference to FIG. 4. The flare gas discharging from the annular orifice 54B forms a perimeter zone discharge as indicated by the arrow 80 in FIG. 6, and this perimeter zone discharge may be diverged from an upwardly rising cylindrical configuration by the deflector ring 82 if provided.

The flare tip assembly 40B may also be equipped with the fluid injector assembly 100, described hereinabove, and with the conventional igniter assembly 90. Also, the upper portion of the internal wall of the liner cylinder may be lined with a refractory (not shown) if required to protect the structure from the burning flare gas.

While the flare tip assembly 40B performs the same function as the flare tip assembly 40A in discharging the flare gas as a perimeter zone discharge as described above, the flare tip assembly 40B further provides a reverse flow seal chamber between the flare conduit 30B and the annular orifice channel 54B. During purge operations, this reverse flow seal chamber serves to entrap a portion of the purge gas generally within the space formed in the reverse flow channel 150 below the seal plate 144 and the lower portion of the annular orifice channel 54B, and this occurs whether the purge gas is heavier or lighter than atmospheric air. The result of this purge gas entrapment is to minimize the amount of purge gas required to retard the backflow of atmospheric air into the flare stack.

It is clear that the present invention is well adapted to carry out the objects and to attain the ends and advantages mentioned as well as those inherent therein. While presently preferred embodiments of the invention have been described for purposes of this disclosure, it will be recognized that numerous changes may be made which will readily suggest themselves to those skilled in the art and which are encompassed within the spirit of the invention disclosed and as defined in the appended claims.

What is claimed is:

1. A flare gas combustion apparatus comprising:

a tubularly shaped flare housing having an upper end;

gas directing means for forming an orifice channel at the upper end of the flare housing and having an inner core surrounded by the orifice channel, the gas directing means comprising a liner member having first and second ends and supported within the flare housing, the orifice channel being the space between the inner wall of the flare housing and the outer wall of the liner member;

seal means for selectively preventing air and gas passage through the inner core of the gas directing means; and a first flare conduit connected in fluid communication with the orifice channel so that a first flare gas portion passing through the first flare conduit is exhausted from the orifice channel at an exit port of the orifice channel at the upper end of the flare housing as a relatively thin layer of discharge gas so that combustion of the discharging first flare portion occurs as a perimeter zone discharge, the inner core of the liner member blocked to passage of the first flare gas portion; and injector means for directing selected fluid into the liner member.

2. A flare gas combustion apparatus comprising:

a tubularly shaped flare housing having an upper end;

gas directing means for forming an orifice channel at the upper end of the flare housing and having an inner core surrounded by the orifice channel, the gas directing means comprising a liner member having first and second ends and supported within the flare housing, the orifice channel being the space between the inner inner wall of the flare housing and the outer wall for the liner member;

seal means for selectively preventing air and gas passage through the inner core of the gas directing means; and a first flare conduit connected in fluid communication with the orifice channel so that a first flare gas portion passing through the first flare conduit is exhausted from the orifice channel at an exit port of the orifice channel at the upper end of the flare housing as a relatively thin layer of discharge gas so that combustion of the discharging first flare portion occurs as a perimeter zone discharge, the inner core of the liner member blocked to passage of the first flare gas portion; and injector means for directing selected fluid into the perimeter zone discharge.

3. The flare gas combustion apparatus of claim 2 wherein the injector means comprises:

a hollow pipe ring supported around the flare housing below the upper end thereof, the pipe ring having at least one discharge aperture therein;

at least one fluid nozzle connected to the pipe ring, the number of fluid nozzles equal to the number of discharge apertures in the pipe ring, each fluid nozzle connected at a discharge aperture, each fluid nozzle extending from the pipe ring and disposed to discharge fluid toward the perimeter zone discharge; and inlet fluid means connected to the pipe ring for directing pressurized selected fluid into the pipe ring.

4. The flare gas combustion apparatus of claim 1, 2, or 3 wherein the gas directing means further comprises:

a deflector ring supported by the liner member near the exit port and having a flare gas diverting surface, the deflector ring positioned so that the perimeter zone discharge is caused to diverge at a predetermined divergent angle.

5. The flare gas combustion apparatus of claim 4 wherein the deflector ring has a plurality of apertures therethrough.

6. A flare gas combustion apparatus comprising:

a flare housing having an upper end;

a liner cylinder having upper and lower ends, an inner core, and being coaxially supported within the flare housing, the liner cylinder forming an annular orifice channel between the inner wall of the flare housing and the outer wall of the liner cylinder;

a first flare connected in fluid communication with the annular orifice channel so that a first flare gas portion passing through the first flare conduit is discharged from the orifice channel at an exit port of the annular orifice channel at the upper end of the flare housing, the first flare gas portion discharging from the exit port of the annular orifice channel forming a relatively thin cylindrically shaped perimeter zone discharge;

seal means for preventing air and gas passage through the inner core of the liner cylinder;

a second flare conduit in fluid communication with the inner core of the liner cylinder so that a second waste gas portion passing to the liner cylinder is dischargeable from the upper end of the liner cylinder as an inner zone discharge during emergency operation;

a flare gas inlet conduit having fluid communication with the first flare conduit and with the second flare conduit;

injector means for directing a selected fluid into the perimeter zone discharge; and wherein the seal means is further characterized as comprising:

liquid seal means interposed between the flare gas inlet conduit and the second flare conduit for preventing flare gas flow from the flare gas inlet conduit to the second flare conduit until the pressure in the flare gas inlet exceed a predeterminded value requiring emergency flare gas discharge.

7. A flare gas combustion apparatus comprising:

a flare housing having an upper end;

a liner cylinder having upper and lower ends, an inner core, and being coaxially supported within the flare housing, the liner cylinder forming an annular orifice channel between the inner wall of the flare housing and the outer wall of the liner cylinder;

a first flare conduit connected in fluid communication with the annular orifice channel so that a first flare gas portion passing through the first flare conduit is discharged from the orifice channel at an exit port of the annular orifice channel at the upper end of the flare housing, the first flare gas portion discharging from the exit port of the annular orifice channel forming a relatively thin cylindrically shaped perimeter zone discharge;

seal means for preventing air and gas passage through the inner core of the liner cylinder;

a second flare conduit in fluid communication with the inner core of the liner cylinder so that a second waste gas portion passing to the liner cylinder is dischargeable from the upper end of the liner cylinder as an inner zone discharge during emergency operation;

a flare gas inlet conduit having communication with the first flare conduit and with the second flare conduit;

injector means for directing a selected fluid into the liner cylinder; and wherein the seal means is further characterized as comprising:

liquid seal means interposed between the flare gas inlet conduit and the second flare conduit for preventing flare gas flow from the flare gas inlet conduit to the second flare conduit until the pressure in the flare gas inlet exceed a predetermined value requiring emergency flare gas discharge.

8. A flare gas combustion apparatus comprising:

a flare housing having an open upper end and a closed lower end;

a liner cylinder having upper and lower ends, an inner core, and being coaxially supported within the flare housing, the liner cylinder forming an annular orifice channel between the inner wall of the flare housing and the outer wall of the liner cylinder, the orifice channel forming an open exit port at its upper end and closed at its lower end;

a first flare conduit connected in fluid communication with the annular orifice channel so that a first flare gas portion passing through the first flare conduit is discharged from the orifice channel at the exit port of the annular orifice channel at the upper end of the flare housing, the first flare gas portion discharging from the exit port of the annular orifice channel forming a relatively thin cylindrically shaped perimeter zone discharge; and seal means disposed in the inner core of the liner cylinder for preventing air and gas passage through the inner core of the liner cylinder, and wherein the first flare conduit extends axially into the liner cylinder through the lower end thereof, an annularly shaped reverse flow channel formed between the inner wall of the liner cylinder, the outer wall of the first flare conduit, and the seal means, the reverse flow channel having fluid communication between the first flare conduit and the annular orifice channel so that a reverse flow fluid seal chamber is provided between the first flare conduit and the annular orifice channel.

9. The flare gas combustion apparatus of claim 6 wherein the injector means comprises:

a hollow pipe ring supported around the flare housing, the pipe ring having a plurality of discharge apertures therein;

a plurality of fluid nozzles connected to the pipe ring, each fluid nozzle connected at a discharge aperture and extending from the pipe ring to discharge fluid toward the perimeter zone discharge; and inlet fluid means connected to the pipe ring for directing a pressurized selected fluid into the pipe ring.

10. The flare gas combustion apparatus of claim 6, 7, 9, or 8 further comprising:

a deflector ring supported by the liner cylinder near the exit port and having a flare gas diverting surface, the deflector ring positioned so that the perimeter zone discharge is caused to diverge at a predetermined divergent angle.

11. The flare gas combustion apparatus of claim 10 wherein the deflector ring has a plurality of apertures therethrough.

12. A flare gas combustion apparatus comprising:

a tubularly shaped flare housing having an upper end;

gas directing means for forming an orifice channel at the upper end of the flare housing and having an inner core surrounded by the orifice channel, the gas directing means comprising a liner member having first and second ends and supported within the flare housing, the orifice channel being the space between the inner wall of the flare housing and the outer wall of the liner member, the orifice channel closed at its lower end and open at its upper end to form an exit port;

a seal plate disposed across the liner member so that gas is prevented from exhausting from the upper end of the liner member; and a first flare conduit connected in fluid communciation with the orifice channel so that a first flare gas portion passing through the first flare conduit is exhausted from the orifice channel at the exit port of the orifice channel at the upper end of the flare housing as a relatively thin layer of discharge gas so that combustion of the discharging first flare portion occurs as a perimeter zone discharge, the inner core of the liner member blocked to passage of the first flare gas portion, and wherein the first flare conduit extends axially into the liner member such that an annularly shaped reverse flow channel is formed between the inner wall of the liner member, the outer wall of the first flare conduit and the seal plate, the reverse flow channel having fluid communication between the first flare conduit and the annular orifice channels so that a reverse flow fluid seal chamber is provided between the first flare conduit and the annular orifice channel.

* * * * *

UNITED STATES PATENT AND TRADEMARK OFFICE

CERTIFICATE OF CORRECTION

PATENT NO. : 4,538,982

DATED : September 3, 1985

INVENTOR(S) : Eugene C. McGill and Robert L. Rawlings

It is certified that error appears in the above-identified patent and that said Letters Patent is hereby corrected as shown below:

In column 1, line 66, the number "3,554,631" should read --3,554,681--; in column 3, line 49, the word "wile" should read --while--; in column 12, line 53, the word "channels" should read --channel--.

Signed and Sealed this

*Fifteenth* Day of *July 1986*

[SEAL]

*Attest:*

DONALD J. QUIGG

*Attesting Officer*

*Commissioner of Patents and Trademarks*